US009202617B2

(12) United States Patent
Zhou et al.

(10) Patent No.: US 9,202,617 B2
(45) Date of Patent: Dec. 1, 2015

(54) LOW PROFILE, SURFACE MOUNT ELECTROMAGNETIC COMPONENT ASSEMBLY AND METHODS OF MANUFACTURE

(71) Applicant: COOPER TECHNOLOGIES COMPANY, Houston, TX (US)

(72) Inventors: Dengyan Zhou, Shanghai (CN); Yipeng Yan, Shanghai (CN); Robert James Bogert, Lake Worth, FL (US); Brent Alan Elliott, Eldorado Hills, CA (US)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 0 days.

(21) Appl. No.: 14/314,625

(22) Filed: Jun. 25, 2014

(65) Prior Publication Data

US 2015/0009004 A1 Jan. 8, 2015

(51) Int. Cl.

| | |
|---|---|
| ***H01F 17/04*** | (2006.01) |
| ***H01F 27/24*** | (2006.01) |
| ***H01F 27/29*** | (2006.01) |
| ***H01F 7/06*** | (2006.01) |
| ***H01F 27/28*** | (2006.01) |
| ***H01F 27/30*** | (2006.01) |
| ***H01F 41/00*** | (2006.01) |

(52) U.S. Cl.

CPC ..... *H01F 27/24* (2013.01); *H01F 27/2847* (2013.01); *H01F 27/292* (2013.01); *H01F 27/306* (2013.01); *H01F 41/00* (2013.01); *Y10T 29/49073* (2015.01)

(58) Field of Classification Search

CPC ... H01F 27/2847; H01F 27/292; H01F 27/24; H01F 27/306; H01F 27/29; H01F 41/00; H01F 41/02; H01F 41/0206

USPC ..... 336/208, 212, 192, 221; 29/606, 602.1

See application file for complete search history.

(56) References Cited

U.S. PATENT DOCUMENTS

| | | | |
|---|---|---|---|
| 6,603,382 | B1 | 8/2003 | Komai et al. |
| 7,791,445 | B2 | 9/2010 | Manoukian et al. |
| 7,986,208 | B2 | 7/2011 | Yan et al. |
| 8,289,121 | B2 | 10/2012 | Yan et al. |
| 8,310,332 | B2 | 11/2012 | Yan et al. |

(Continued)

FOREIGN PATENT DOCUMENTS

| | | |
|---|---|---|
| CN | 1343996 | 4/2002 |
| CN | 101217070 | 7/2008 |

(Continued)

OTHER PUBLICATIONS

Extended European Search Report of Application No. 14175506.6; Nov. 24, 2014; 7 pages.

*Primary Examiner* — Mangtin Lian

(74) *Attorney, Agent, or Firm* — Armstrong Teasdale LLP

(57) ABSTRACT

A low profile surface mount electromagnetic component such as a power inductor includes first and second core pieces arranged side by side and having longitudinal side walls facing one another. A preformed coil winding includes vertical legs that are received in vertical slots of the facing longitudinal sidewalls of the component. Inset depressed sections are provided in the top surfaces of the first and second magnetic core pieces and receive a main winding section of the coil winding. Surface mount terminal tabs extend on the bottom surfaces of both the first and second magnetic core pieces.

30 Claims, 6 Drawing Sheets

(56) References Cited

U.S. PATENT DOCUMENTS

| | | | | |
|---|---|---|---|---|
| 8,378,777 | B2 | 2/2013 | Yan et al. | |
| 8,400,245 | B2 | 3/2013 | Yan et al. | |
| 8,659,379 | B2 | 2/2014 | Yan et al. | |
| 2004/0017276 | A1* | 1/2004 | Chen et al. | 336/192 |
| 2004/0160298 | A1* | 8/2004 | Hsu et al. | 336/83 |
| 2006/0145800 | A1* | 7/2006 | Dadafshar et al. | 336/82 |
| 2010/0007451 | A1 | 1/2010 | Yan et al. | |
| 2010/0013587 | A1* | 1/2010 | Yan et al. | 336/192 |
| 2010/0271161 | A1 | 10/2010 | Yan et al. | |
| 2011/0169476 | A1 | 7/2011 | Ikriannikov et al. | |
| 2013/0099886 | A1 | 4/2013 | Yan et al. | |

FOREIGN PATENT DOCUMENTS

| | | | |
|---|---|---|---|
| DE | 203 08 836 | U1 | 9/2003 |
| JP | 24215 | | 1/1990 |
| JP | 04286305 | | 10/1992 |
| JP | 06005450 | | 1/1994 |
| JP | HEI 6290975 | | 10/1994 |
| JP | 09306715 | | 11/1997 |
| JP | 10335146 | | 12/1998 |
| JP | 11307346 | | 11/1999 |
| JP | 2000315610 | A | 11/2000 |
| JP | 2001257124 | A | 9/2001 |
| JP | 200257049 | A | 2/2002 |
| JP | 2004165539 | | 6/2004 |
| JP | 2004241678 | | 8/2004 |
| JP | 2005064319 | | 3/2005 |
| JP | 2005260130 | | 9/2005 |
| JP | 2005310865 | | 11/2005 |
| JP | 2005310866 | | 11/2005 |
| JP | 2006004957 | | 1/2006 |
| JP | 200660061 | A | 3/2006 |
| JP | 2007123376 | | 5/2007 |
| JP | 2007165779 | A | 6/2007 |
| JP | 200878177 | A | 4/2008 |
| TW | 200625351 | | 7/2006 |

* cited by examiner

LOW PROFILE, SURFACE MOUNT ELECTROMAGNETIC COMPONENT ASSEMBLY AND METHODS OF MANUFACTURE

CROSS REFERENCE TO RELATED APPLICATIONS

This application is based on and claims the benefit of priority from Chinese Patent Application No. 201310381398.3 filed Jul. 3, 2013, the disclosure of which is hereby incorporated by reference in its entirety.

BACKGROUND OF THE INVENTION

The field of the invention relates generally to electromagnetic components such as inductors, and more particularly to miniaturized, surface mount power inductor components for circuit board applications.

Power inductors are used in power supply management applications and power management circuitry on circuit boards for powering a host of electronic devices, including but not necessarily limited to hand held electronic devices. Power inductors are designed to induce magnetic fields via current flowing through one or more conductive windings, and store energy via the generation of magnetic fields in magnetic cores associated with the windings. Power inductors also return the stored energy to the associated electrical circuit as the current through the winding and may, for example, provide regulated power from rapidly switching power supplies.

Recent trends to produce increasingly powerful, yet smaller electronic devices have led to numerous challenges to the electronics industry. Electronic devices such as smart phones, personal digital assistant (PDA) devices, entertainment devices, and portable computer devices, to name a few, are now widely owned and operated by a large, and growing, population of users. Such devices include an impressive, and rapidly expanding, array of features allowing such devices to interconnect with a plurality of communication networks, including but not limited to the Internet, as well as other electronic devices. Rapid information exchange using wireless communication platforms is possible using such devices, and such devices have become very convenient and popular to business and personal users alike.

For surface mount component manufacturers for circuit board applications required by such electronic devices, the challenge has been to provide increasingly miniaturized components so as to minimize the area occupied on a circuit board by the component (sometimes referred to as the component "footprint") and also its height measured in a direction parallel to a plane of the circuit board (sometimes referred to as the component "profile"). By decreasing the footprint and profile, the size of the circuit board assemblies for electronic devices can be reduced and/or the component density on the circuit board(s) can be increased, which allows for reductions in size of the electronic device itself or increased capabilities of a device with comparable size. Miniaturizing electronic components in a cost effective manner has introduced a number of practical challenges to electronic component manufacturers in a highly competitive marketplace. Because of the high volume of components needed for electronic devices in great demand, cost reduction in fabricating components has been of great practical interest to electronic component manufacturers.

In order to meet increasing demand for electronic devices, especially hand held devices, each generation of electronic devices need to be not only smaller, but offer increased functional features and capabilities. As a result, the electronic devices must be increasingly powerful devices. For some types of components, such as magnetic components that provide energy storage and regulation capabilities, meeting increased power demands while continuing to reduce the size of components that are already quite small, has proven challenging.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Exemplary embodiments of inventive electromagnetic component assemblies and constructions are described below for higher current and power applications having low profiles that are difficult, if not impossible, to achieve, using conventional techniques. Electromagnetic components and devices such as power inductors components may also be fabricated with reduced cost compared to other known miniaturized power inductor constructions. Manufacturing methodology and steps associated with the devices described are in part apparent and in part specifically described below but are believed to be well within the purview of those in the art without further explanation.

Figure 1:
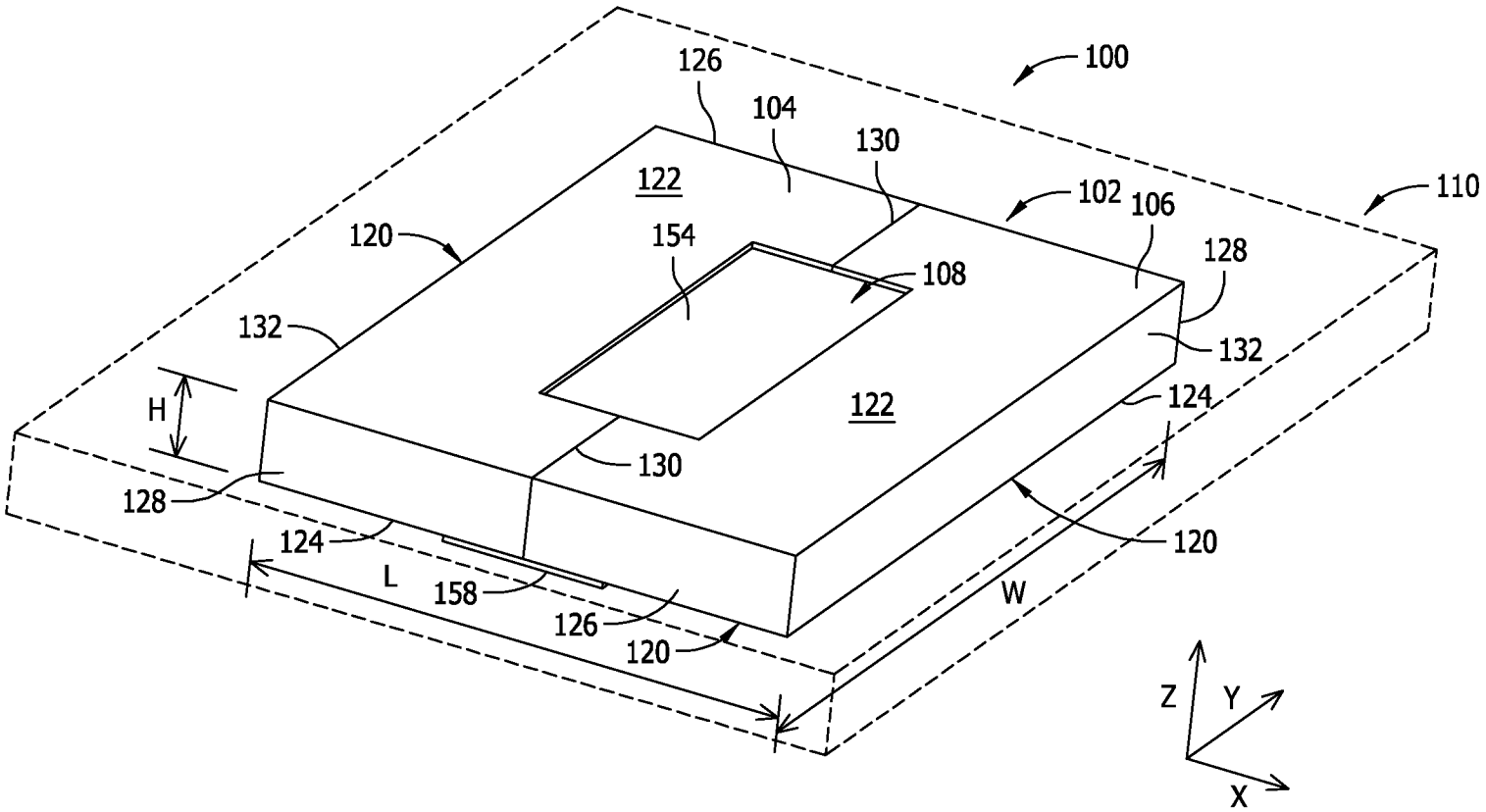
FIG. 1 is a top perspective view of a first exemplary embodiment of a surface mount, electromagnetic component such as a power inductor component.

FIG. 1 is a top perspective view of a first exemplary embodiment of a surface mount, electromagnetic component 100. As described below, the component 100 is configured as a power inductor component, although other types of electromagnetic components may benefit from the teachings described below, including but not limited to inductor components other than power inductors, and also including transformer components.

As shown in FIG. 1, the component 100 generally includes a magnetic core 102 defined by a first core piece 104 and a second core piece 106. A coil winding 108 is contained in respective portions of each of the first and second core pieces 104, 106. In combination, the core pieces 104, 106 impart on overall length L of the magnetic core 102 along a first dimension such as an x axis of a Cartesian coordinate system. Each core piece 104, 106 also has a width W measured along a second dimension perpendicular to the first axis such as a y axis of a Cartesian coordinate system, and a height H measured along a third dimension perpendicular to the first and second axis such as a z axis of a Cartesian coordinate system. As seen in the example of FIG. 1, the dimensions L and W are much greater than the dimension H, such that when the component 100 is surface mounted on a circuit board 110 in the x, y plane the component 100 has a small height dimension H along the z axis facilitating use of the circuit board 110 to provide a slim electronic device. The coil winding 108 is relatively large, however, and in the x, y plane the length L and width W of the core 102 formed by the combination of the core pieces 104, 106 allows the component to capably handle higher current, higher power applications beyond the limits of conventional electromagnetic component constructions.

Figure 2:
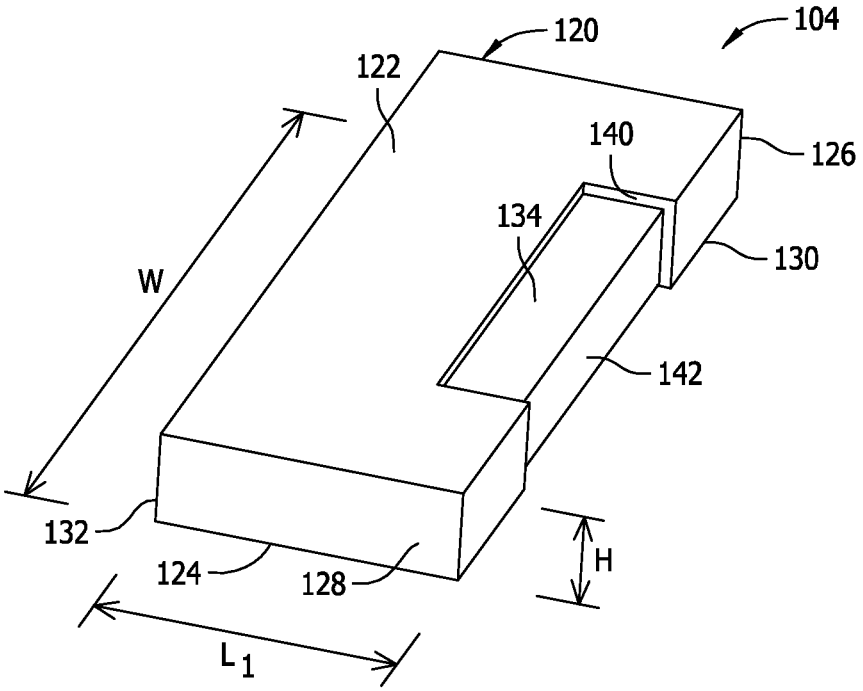
FIG. 2 is a top perspective view of a first exemplary core piece of the electromagnetic core component shown in FIG. 1.
Figure 4:
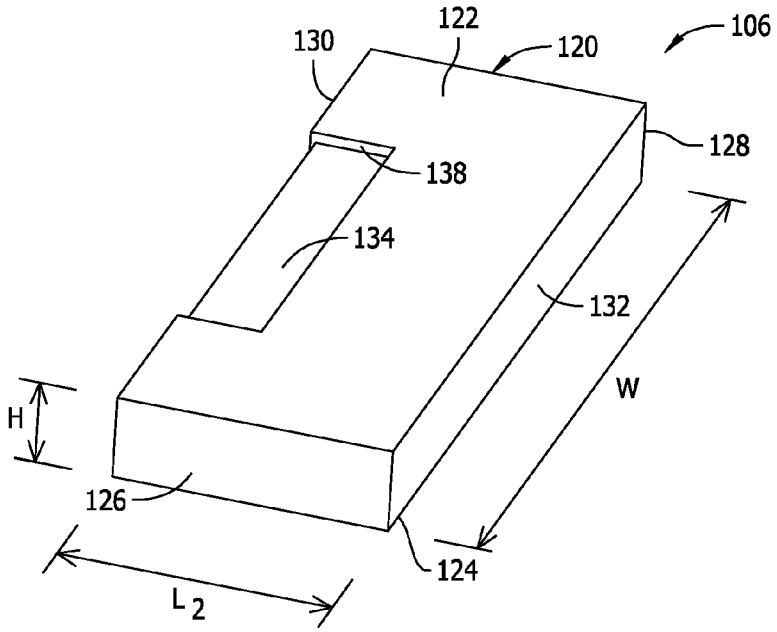
FIG. 4 is a top perspective view of a second exemplary core piece of the electromagnetic core component shown in FIG. 1.
Figure 5:
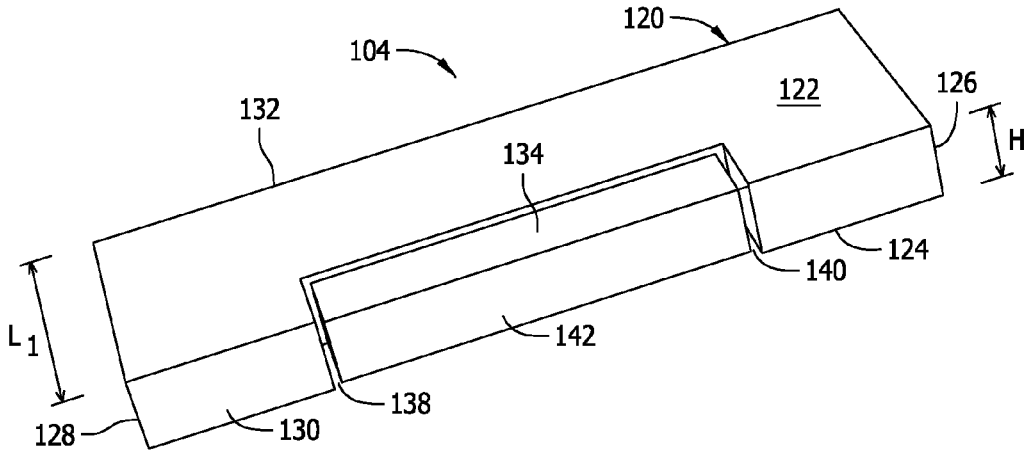
FIG. 5 is another top perspective view of the first core piece shown in FIG. 1.

FIGS. 2 and 5 are top perspective views of the first exemplary core piece 104 illustrating further details of the construction thereof. FIG. 4 illustrates the second exemplary core piece 106 that may be similarly constructed to the first core piece 104 in contemplated embodiments.

The core pieces 104, 106, as seen in FIGS. 2, 4 and 5 each generally include a magnetic body 120 formed from soft magnetic particle materials utilizing known techniques such as molding of granular magnetic particles to produce the desired shape. Soft magnetic powder particles used to fabricate the core pieces 104, 106 may include Ferrite particles, Iron (Fe) particles, Sendust (Fe—Si—Al) particles, MPP (Ni—Mo—Fe) particles, HighFlux (Ni—Fe) particles, Megaflux (Fe—Si Alloy) particles, iron-based amorphous powder particles, cobalt-based amorphous powder particles, and other suitable materials known in the art. Combinations of such magnetic powder particle materials may also be utilized if desired. The magnetic powder particles may be obtained using known methods and techniques. The magnetic powder particles may be coated with an insulating material such the magnetic bodies 120 of the core pieces 104, 106 possess-so called distributed gap properties.

Each magnetic body 120 in each core piece 104, 106 is formed with a generally rectangular configuration including a generally planar top surface 122 and a generally planar opposing surface 124 opposing the top surface. Each surface 122, 124 extends parallel to the x, y plane of FIG. 1 and parallel to the major surface of the circuit board 110. The magnetic body 120 in each core piece 104, 106 further includes generally planar and opposing lateral side walls 126, 128 interconnecting the top and bottom surfaces 122, 124 having a respective dimension $L_1$ and $L_2$ and a dimension H in the x, z plane of FIG. 1 and thus extend perpendicular to the major surface of the circuit board 110 as shown in FIG. 1. The magnetic body 120 in each core piece 104, 106 also includes opposing longitudinal side walls 130, 132 interconnecting the top and bottom surfaces and having a respective dimension W and H in the y, z plane of FIG. 1 and thus also extend perpendicular to the major surface of the circuit board 110 as shown in FIG. 1.

In the example shown, the surface of the longitudinal side wall 132 of each core piece is generally flat and planar, while the surface of the opposing longitudinal side wall 130 is contoured. Moreover, and in the example shown, the bottom surface 124 of each core piece 104, 106 is generally flat, while the top surface 122 is contoured. The contours in the top surface 122 and the longitudinal side wall 130 may abut one another to accommodate the coil winding 108 as explained below.

As seen in FIGS. 2 and 5, the top surface 122 includes an inset depressed surface 134 having a height less than the height H of the remainder of the top surface 122. The inset surface 134 extends adjacent to and is accessible from the longitudinal side wall 130, but is spaced from each of the lateral side walls 126, 128. The surface 134 is recessed from, but extends generally parallel to the top surface 120 to accommodate a portion of the coil winding 108.

The longitudinal side wall 130, as also shown in FIG. 5, includes vertical slots 138, 140 extending in a direction generally parallel to the lateral side walls 126, 128 and defining lateral ends of the recessed surface 134. That is, the slots extend in a direction perpendicular to the surface of the longitudinal side wall 130 for a distance about equal to the corresponding distance of the recessed surface 134 measured in a corresponding direction.

In the example of FIG. 5, the longitudinal side wall 130 of the core piece 104 also includes an inset surface 142 extending between the vertical slots 138, 140. The inset surface 142 is slightly spaced inwardly from the outer surface of the longitudinal side wall 130. In other words, while the outer surface of the side wall 130 extends at the distance L1 from the opposed longitudinal side wall 132, the inset surface 142 extends at a distance less than $L_1$ from the opposed longitudinal side wall 132. As such, the inset surface 142 in the illustrated embodiment extends in a y, z plane of FIG. 1 that is slightly offset from the y, z plane of the outer surface of the side wall 130. When the component 100 is assembled as described below, the inset surface 142 produces a physical gap in the core 102 that may enhance energy storage in the component 100 in certain applications.

Figure 3:
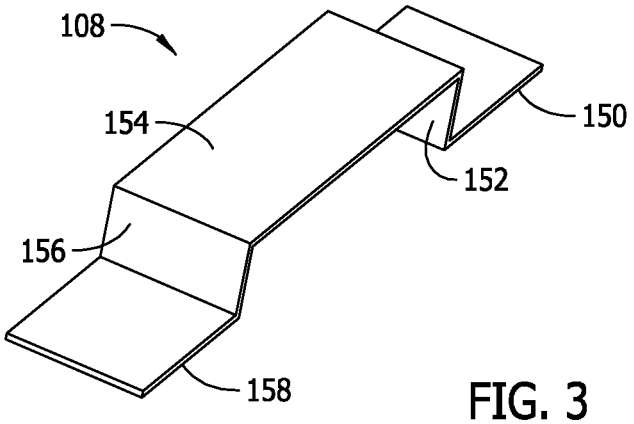
FIG. 3 is a top perspective view of an exemplary coil winding for the electromagnetic core component shown in FIG. 1.

FIG. 3 is a top perspective view of the exemplary coil winding 108 for component 100 shown in FIG. 1. The coil winding 108 may be separately formed and fabricated from the core pieces 104 and 106 and may be provided for final assembly without having to further shape of any of the parts. The coil winding 108 is sometimes referred to as a preformed coil and is distinguished from a coil winding that is bent, shaped or otherwise formed over or around the outer surfaces of a core piece to its final shape as the component is fabricated. Preformed coils are advantageous because bending or shaping the coils around the outer surfaces of a core piece can crack the relatively fragile core pieces and compromise the performance and reliability of the constructed devices. This is particularly so as the core pieces become increasingly miniaturized to meet the needs of modern electronic devices. Because the core pieces 104, 106 are utilized with a preformed coil winding 108, they may generally be thinner as measured along the z axis than conventional component assemblies having non-preformed coil windings.

As seen in FIG. 3, the coil winding 108 may be fabricated from a sheet of electrically conductive material or conductive metal alloy. The coil winding 108 may be formed as shown to include a first and generally horizontal surface mount terminal tab 150, a first vertical leg 152 extending upwardly from a proximal end of the terminal tab 150, a horizontal main winding portion 154 extending perpendicular to the vertical leg 152 and generally parallel to a plane of the first terminal pad 150, a second vertical leg 156 extending downwardly from the main winding portion and generally parallel to the first vertical leg 152, and a second and generally horizontal surface mount terminal tab 158 extending from the second vertical leg 156. The surface mount terminal tabs 150, 158 extend away from the vertical labs 152, 156 in opposite directions from one another, and also extend generally coplanar to one another. The main winding portion 154 extends generally parallel to, but is spaced from, the plane of the surface mount terminal tabs 150, 158. The coil winding 154 in the exemplary embodiment shown completes less than one complete turn, but because of its relative size, provides ample inductance to the component 100 in use.

The coil winding 108 is fabricated from a relatively thin electrically conductive material measured in the H dimension (the z plane of FIG. 1), yet has relatively large dimensions in the L and W dimensions (the x, y plane of FIG. 1). The large L and W dimensions provide an increased cross sectional area of the coil winding that, in turn, lowers the direct current resistance of the component 100 in use. In many types of conventional electromagnetic components, there is a generally tendency to provide smaller and smaller coils for miniaturized components, whereas in the component 100 a pronounced increase in the size of the coil winding 108 has been found to be beneficial.

FIG. 4 shows the second core piece 106, which as described above, is constructed similarly to the core piece 104 (FIGS. 2 and 5). Like the core piece 104, the core piece 106 includes a contoured top surface 122 including the inset depressed surface 134. Vertical slots 138, 140 are also formed as described in the core piece 104 define the lateral ends of the inset depressed surface 134. Unlike the core piece 104, however, in the example shown the core piece 106 does not include the inset surface 142 in the longitudinal side wall 130. As such, in the exemplary embodiment depicted, there is a slight difference in the shapes of the core pieces 104, 106. This need not be the case in all embodiments, however. It is contemplated the core pieces 104, 106 may be identically shaped in other embodiments, and as such the core pieces 104, 106 in other embodiments may be each be formed with or without the inset surface 142 as described.

To assemble the component 100, the core pieces 104, 106 are arranged side-by-side on either side of the coil winding 108. The core pieces 104, 106 and the coil winding 108 are inter-fit such that the vertical leg 152 of the coil winding 108 extends partly in the vertical slot 140 of the core piece 104 and partly in the vertical slot 138 of the core piece 106. Likewise, the vertical leg 156 of the coil winding 108 is extended partly in the vertical slot 138 of the core piece 104 and partly in the vertical slot 140 of the core piece 106. The core pieces 104, 106 are moved or drawn toward one other, with the vertical legs 152, 156 of the coil winding 108 in the slots 138, 140 in each core piece 104, 106 until the longitudinal side walls 130 abut one another as seen in FIG. 1. The main winding section 154 of the coil winding 108 becomes seated in the inset depressed surface 134 in each core piece 104, 106 as the core pieces 104, 106 are assembled to the coil winding 108. Because the core piece 104 includes the inset surface 142 and also because the core piece 106 does not include the inset surface 142, when the longitudinal side walls 130 of the core pieces 104, 106 are brought together as shown in FIG. 1, a gap is created between the inset surface 142 in the core piece 104 and the longitudinal side wall 130 of the core piece 106 just beneath the main winding section 154. As mentioned above, the gap enhances energy storage of the component 100 in use, and is particularly advantageous for a power inductor application.

In the illustrated embodiment, about half of each vertical leg 152, 156 and about half of the main winding section 158 of the coil winding 108 is accommodated in each core piece 104, 106. The main winding section 158 is exposed on the top surfaces 122 of each core piece 104 and 106, the vertical legs 152, 156 are captured in the slots of the core pieces 104, 106, and the surface mount terminal tabs 150, 158 are extended on the bottom surfaces 124 of each core piece 104, 106. In the example shown in the drawings, the length $L_1$ and $L_2$ of each core piece 104, 106 is equal and in combination provide the overall length L of the component 100 as shown in FIG. 1. In other embodiments, however, the length $L_1$ and $L_2$ of each core piece 104, 106 need not be equal.

As can be seen in FIG. 1, each surface mount terminal tab 150, 158 extends on portions of both bottom surfaces 124 of the core pieces 104, 106. More specifically, about half of each of the surface mount terminal tabs 150, 158 extends on the bottom surface 124 of the core piece 104, while the other half of each of the surface mount terminal tabs 150, 158 extends on the bottom surface 124 of the core piece 106. While an exemplary coil winding 108 and arrangement of terminal tabs 150, 158 is shown, it is contemplated that other arrangements are possible.

The side-by-side arrangement of the core pieces 104, 106 in the component 100 provides considerably smaller components than conventional component arrangements having cores stacked vertically on one another with a coil in between. The side-by-side arrangement of the core pieces 104, 106 in a common plane also facilitates the use of a larger coil winding 150 that can more capably perform in higher power, higher current applications.

Figure 6:
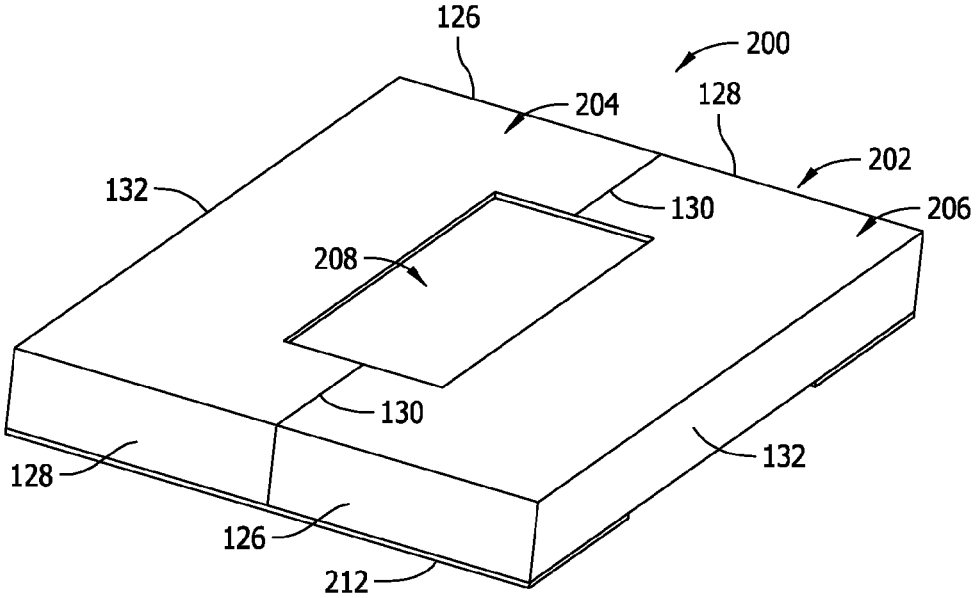
FIG. 6 is a top perspective view of a second exemplary embodiment of a surface mount, electromagnetic component such as a power inductor component.

FIG. 6 is a top perspective view of a second exemplary embodiment of a surface mount, electromagnetic component 200 that is similar in many aspects to the component 100 described above. The component 200 includes a magnetic core 202 defined by a first core piece 204 and a second core piece 206, and a coil winding 208 integrated partly in the first core piece 204 and partly in the second core piece 206.

Figure 7:
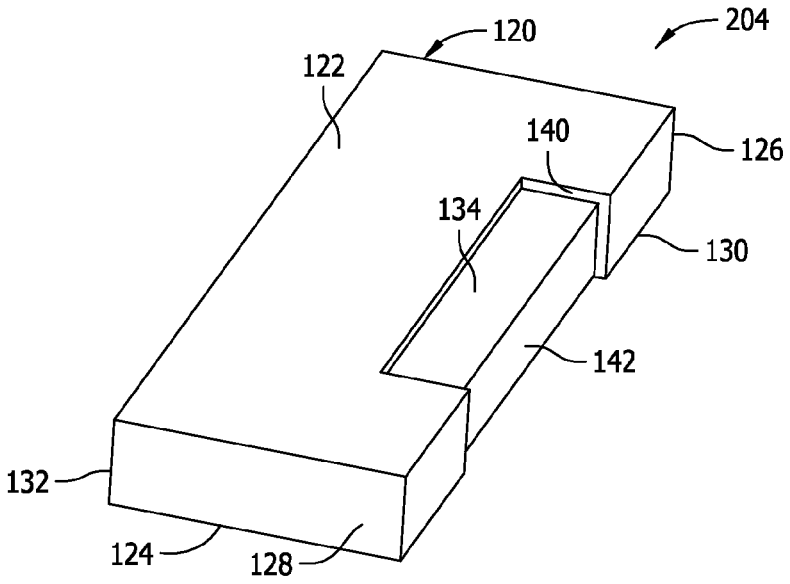
FIG. 7 is a top perspective view of a first exemplary core piece of the electromagnetic core component shown in FIG. 6.
Figure 9:
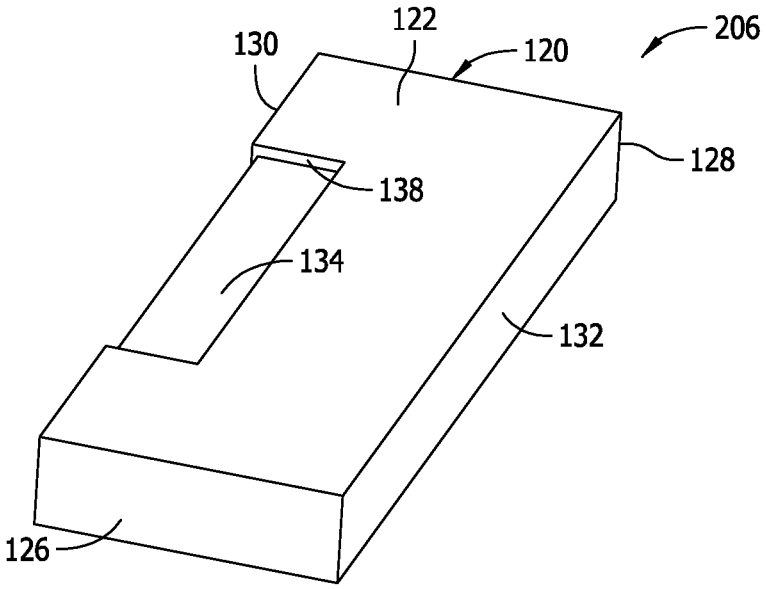
FIG. 9 is a perspective view of a second exemplary core piece of the electromagnetic core component shown in FIG. 6.

FIG. 7 illustrates the first core piece 204, which can be seen to be substantially similar to the core piece 104 as described above. FIG. 9 likewise illustrates the second core piece 206, which can be seen to be substantially similar to the core piece 106 as described above.

Figure 8:
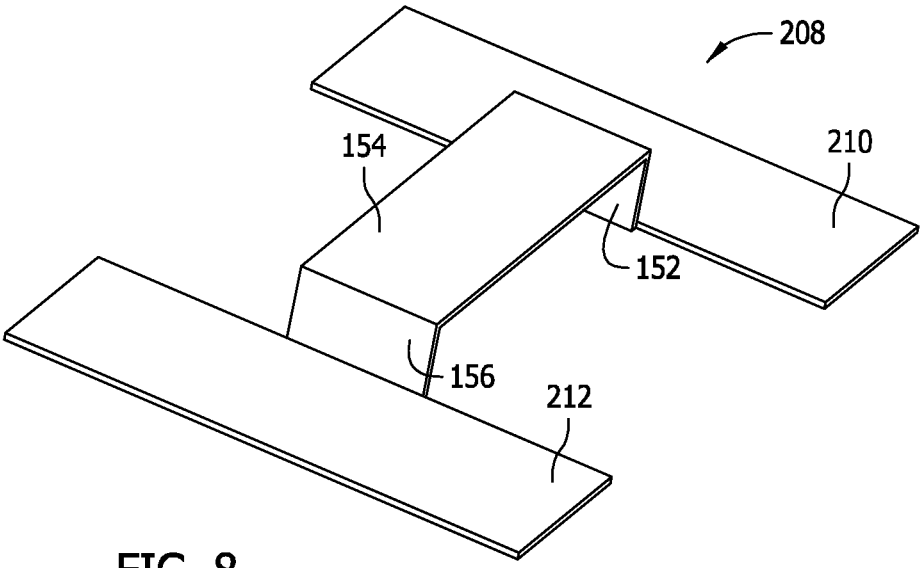
FIG. 8 is a perspective view of an exemplary coil winding for the electromagnetic core component shown in FIG. 6.

FIG. 8 is a perspective view of an exemplary coil winding 208 for the electromagnetic core component 200 shown in FIG. 6. The coil winding 208 is seen to be similar to the coil winding 108 as described above, but includes elongated surface mount terminal tabs 210, 212 in lieu of the smaller surface mount terminal tabs 150, 158 shown in FIG. 3 of the component 100. The elongated surface mount terminal tabs 210, 212 span a combined length L of the core pieces 204, 206 when the component is assembled.

Figure 10:
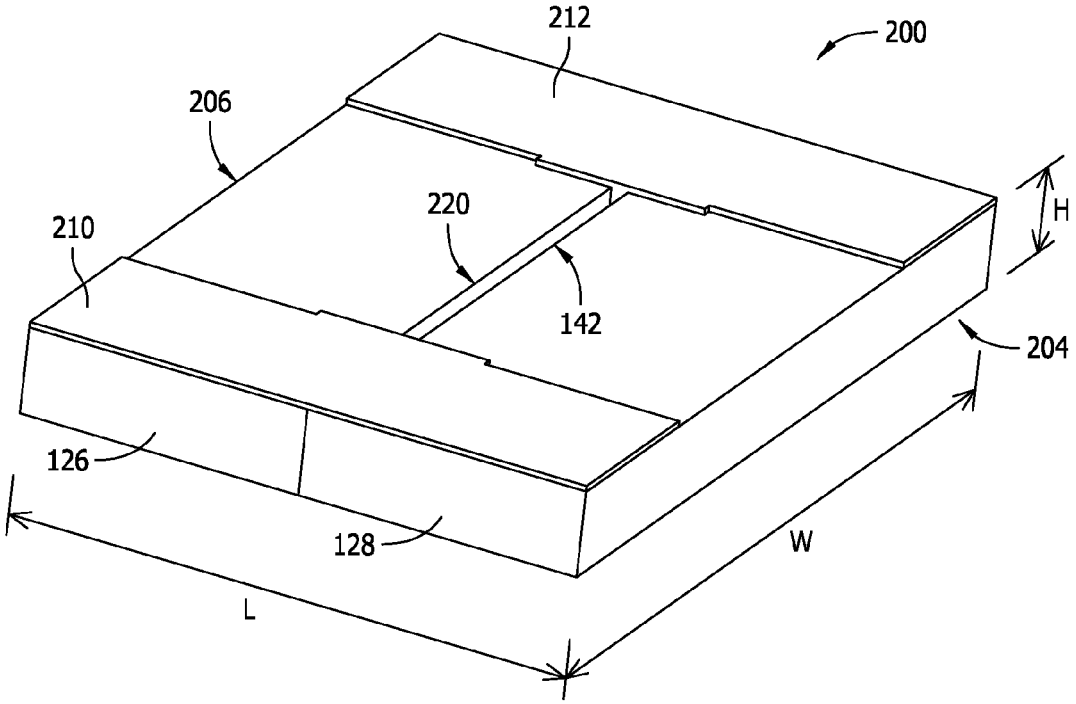
FIG. 10 is a bottom perspective view of the component shown in FIG. 6.

FIG. 10 is a bottom perspective view of the component 200 showing the elongated surface mount terminal tabs 210, 212 extending entirely across the overall length L of component 200 including the core pieces 204, 206. FIG. 10 also shows the physical gap 210 provided by the inset surface 142 of the first core piece 204.

Compared to the component 100 described above the larger surface mount terminal tabs 210, 212 provide a large contact area for surface mounting to the circuit board 110. The larger contact area reduces direct current resistance (DCR) of the component 200 in se even further than the component 100. Decreasing DCR beneficially increases the efficiency of the component 200 in operation and allows the component 200 to operate at a lower temperature than comparable devices operating with an increased DCR.

The benefits and advantages of the presently claimed invention are now believed to have been amply illustrated in relation to the exemplary embodiments disclosed.

An electromagnetic component assembly has been disclosed including: a first magnetic core piece having a top surface, a bottom surface opposing the top surface, and a longitudinal side wall interconnecting the top and bottom surfaces; a second magnetic core piece having a top surface, a bottom surface opposing the top surface, and a longitudinal side wall interconnecting the top and bottom surfaces; and a preformed coil winding separately provided from each of the first and second cores, the coil winding including a first horizontally extending surface mount terminal tab and a first vertical leg; wherein at least one of the first and second core pieces includes a first vertical slot formed in the longitudinal side wall, the first vertical leg received in the first vertical slot and the first surface mount terminal pad extending on the bottom surfaces of the first and second core pieces. The component may be a power inductor.

Optionally, the first and second core pieces may be arranged side-by-side with the longitudinal side wall of the respective first and second core pieces facing one another. The at least one of the first and second core pieces may include a second vertical slot formed in the longitudinal side wall, and the second vertical slot may be spaced from the first vertical slot. The top surface of the at least one of the first and second core pieces may include an inset depressed surface extending between the first and second vertical slots. The coil winding may further include a main winding section, with the main winding section being received in the inset depressed surface. Each of the top surfaces of the at least one of the first and second core pieces may include an inset depressed surface; a portion of the main winding section may be partly received in the inset depressed surface of the first core piece; and a remaining portion of the main winding section may be partly received in the inset depressed surface of the first core piece. The main winding section may be exposed on the top surface of the first core piece and may be exposed on the top surface of the second core piece.

Also optionally, each of the longitudinal side walls of the first and second core pieces may include a first vertical slot; the first vertical leg may be received partly in the first vertical slot of the first core piece; and the first vertical leg may be received partly in the first vertical slot of the second core piece. The coil winding may further include a second vertical leg and a second surface mount terminal tab. The second surface mount terminal tab may extend in an opposite direction to the first surface mount terminal tab. Each of the first and second core pieces may include a first vertical slot and a second vertical slot formed in the longitudinal side wall; the first and second vertical slots may be spaced from one another; the first vertical leg of the coil winding may be received in the first vertical slot of each of the first and second core pieces; and the second vertical leg of the coil winding may be received in the second vertical slot of each of the first and second core pieces.

Also optionally, at least one of the first and second core pieces include may include an inset surface formed in the longitudinal side wall, and the inset surface may define a physical gap when the first and second core pieces are arranged side-by-side with the longitudinal side wall of the respective first and second core pieces facing one another. Each of the first and second core pieces may further include a lateral side wall extending perpendicular to the longitudinal side wall, with the lateral side walls of the first and second core pieces defining an overall length dimension of the component in combination. The first terminal tab may extend entirely across the length dimension of the component.

A method of manufacturing an electromagnetic component assembly has also been disclosed. The method includes: providing a first magnetic core piece having a top surface, a bottom surface opposing the top surface, and a longitudinal side wall interconnecting the top and bottom surfaces; providing a second magnetic core piece having a top surface, a bottom surface opposing the top surface, and a longitudinal side wall interconnecting the top and bottom surfaces; wherein at least one of the first and second core pieces includes a first vertical slot formed in the longitudinal side wall; providing a preformed coil winding separately provided from each of the first and second cores, the coil winding including a first horizontally extending surface mount terminal tab and a first vertical leg; and receiving the first vertical leg in the first vertical slot and extending the first surface mount terminal pad on the bottom surfaces of the first and second core pieces. A component may be formed by the method of claim 16, and the component may be a power inductor.

Optionally, the method may also include arranging the first and second core pieces side-by-side with the longitudinal side wall of the respective first and second core pieces facing one another. The top surface of the at least one of the first and second core pieces includes an inset depressed surface extending between the first and second vertical slots, the coil winding may further include a main winding section, and the method may further include receiving the main winding section in the inset depressed surface. Each of the top surfaces of the at least one of the first and second core pieces may also include an inset depressed surface, and the method may further include: receiving a portion of the main winding section partly in the inset depressed surface of the first core piece, and receiving a remaining portion of the main winding section in the inset depressed surface of the first core piece. The method may include exposing the main winding section on the top surface of the first core piece and on the top surface of the second core piece.

Also optionally, each of the longitudinal side walls of the first and second core pieces may include a first vertical slot, and the method may include: receiving the first vertical leg partly in the first vertical slot of the first core piece, and receiving the first vertical leg partly in the first vertical slot of the second core piece.

The coil winding may include a second vertical leg and a second surface mount terminal tab, wherein the second surface mount terminal tab extends in an opposite direction to the first surface mount terminal tab, wherein the each of the first and second core pieces includes a first vertical slot and a second vertical slot formed in the longitudinal side wall, the first and second vertical slots being spaced from one another, and the method may include: receiving the first vertical leg of the coil winding in the first vertical slot of each of the first and second core pieces, and receiving the second vertical leg of the coil winding in the second vertical slot of each of the first and second core pieces.

At least one of the first and second core pieces may include an inset surface formed in the longitudinal side wall, and the method may include defining a physical gap with the inset surface when the first and second core pieces are arranged side-by-side with the longitudinal side wall of the respective first and second core pieces facing one another.

Each of the first and second core pieces may also include a lateral side wall extending perpendicular to the longitudinal side wall, the lateral side walls of the first and second core pieces defining an overall length dimension of the component in combination, and the method also including extending the first terminal tab entirely across the length dimension of the component.

An electromagnetic component assembly has also been disclosed including: a first magnetic core piece having a top surface, a bottom surface opposing the top surface, and a longitudinal side wall interconnecting the top and bottom surfaces; a second magnetic core piece having a top surface, a bottom surface opposing the top surface, and a longitudinal side wall interconnecting the top and bottom surfaces; and a preformed coil winding formed separately from each of the first and second cores, the coil winding including a pair of horizontally extending surface mount terminal tabs and, a pair of vertical legs extending upwardly from the pair of surface mount terminal tabs, and a main winding section extending between the pair of vertical legs; wherein each of the first and second core pieces includes a first vertical slot and a second vertical slot formed in the longitudinal side wall thereof; wherein the pair of vertical legs are received in the first vertical slot and the second vertical slot of each of the first and second core pieces; wherein the pair of surface mount terminal pads extend on the bottom surfaces of the first and second core pieces; and wherein the main winding section extends on the top surface of the first and second core pieces.

Optionally, each of the top surfaces of the first and second core pieces may include an inset depressed surface, with the main winding section received in the inset depressed surfaces. At least one of the longitudinal side walls of the first and second core pieces may include an inset surface forming a physical gap when the longitudinal side walls of the first and second core pieces are drawn together. The component may be a power inductor.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An electromagnetic component assembly comprising:

a first magnetic core piece having a top surface, a bottom surface opposing the top surface, and a longitudinal side wall interconnecting the top and bottom surfaces;

a second magnetic core piece having a top surface, a bottom surface opposing the top surface, and a longitudinal side wall interconnecting the top and bottom surfaces;

wherein the top surface of each of the first magnetic core piece and the second magnetic core piece is formed with an inset depressed surface; and a preformed coil winding separately provided from each of the first and second core pieces, the preformed coil winding defining less than one complete turn and including a first horizontally extending surface mount terminal tab, a first vertical leg and a main winding section extending parallel to the first horizontally extending surface mount terminal tab;

wherein each of the first and second magnetic core pieces includes a first vertical slot formed in the longitudinal side wall, the first vertical leg received partly in the first vertical slot of each of the first and second magnetic core pieces, the first surface mount terminal tab extending on the bottom surfaces of each of the first and second magnetic core pieces, and the main winding section extending partly on the inset depressed surface of each of the first and second magnetic core pieces.

2. The electromagnetic component assembly of claim 1, wherein the first and second magnetic core pieces are arranged side-by-side with the longitudinal side wall of the respective first and second magnetic core pieces facing one another.

3. The electromagnetic component assembly of claim 1, wherein each of the first and second magnetic core pieces includes a second vertical slot formed in the longitudinal side wall, the second vertical slot spaced from the first vertical slot.

4. The electromagnetic component assembly of claim 3, wherein the inset depressed surface extends between the first and second vertical slots in each of the first and second magnetic core pieces.

5. The electromagnetic component assembly of claim 1, wherein the main winding section is exposed on the top surface of the first magnetic core piece and is exposed on the top surface of the second magnetic core piece.

6. The electromagnetic component assembly of claim 1, wherein the preformed coil winding further includes a second vertical leg and a second surface mount terminal tab.

7. The electromagnetic component assembly of claim 6, wherein the second surface mount terminal tab extends in an opposite direction to the first surface mount terminal tab.

8. The electromagnetic component assembly of claim 6, wherein each of the first and second magnetic core pieces includes a second vertical slot formed in the longitudinal side wall, the first and second vertical slots being spaced from one another, and wherein the second vertical leg of the preformed coil winding is received partly in the second vertical slot of each of the first and second magnetic core pieces.

9. The electromagnetic component assembly of claim 1, wherein each of the first and second magnetic core pieces further includes a lateral side wall extending perpendicular to the longitudinal side wall, the lateral side walls of the first and second magnetic core pieces defining an overall length dimension of the component in combination.

10. The electromagnetic component assembly of claim 9, wherein the first terminal tab extends entirely across the length dimension of the component.

11. The electromagnetic component assembly of claim 1, wherein the component is a power inductor.

12. The electromagnetic component assembly of claim 1, wherein the inset depressed surface extends adjacent to and is accessible from the longitudinal side wall.

13. The electromagnetic component assembly of claim 12, wherein the first and second magnetic core pieces further include first and second lateral walls extending between the top and bottom surfaces, and wherein the inset depressed surface is spaced from each of the first and second lateral side walls.

14. The electromagnetic component assembly of claim 1, wherein the first and second core pieces are arranged side-by-side, and wherein the first and second core pieces are not identically shaped.

15. The electromagnetic component assembly of claim 14, wherein the longitudinal side wall of the first and second magnetic core pieces face one another, wherein the longitudinal side wall of the first magnetic core piece is contoured, and wherein the longitudinal side wall of the second magnetic core piece is flat.

16. The electromagnetic component assembly of claim 1, wherein each of the first and second magnetic core pieces has a length dimension measured parallel to the longitudinal side wall, a width dimension measured parallel to a lateral side wall, and a height dimension measured perpendicular to the bottom surface;

wherein the width dimension is much greater than the length dimension; and wherein the length dimension is much greater than the height dimension.

17. The electromagnetic component assembly of claim 16, wherein the main winding section of the preformed coil has a corresponding length, width and height dimension to the first and second magnetic core pieces;

wherein the width dimension of the main winding section is much greater than the height dimension of the main winding section; and wherein the length of the main winding section is much greater than the width of the main winding section.

18. The electromagnetic component assembly of claim 17, wherein the length of the main winding section is less than the length of the first and second magnetic core pieces.

19. The electromagnetic component assembly of claim 2, wherein at least one of the first and second magnetic core pieces includes an inset surface formed in the longitudinal side wall, the inset surface defining a physical gap when the first and second magnetic core pieces are arranged side-by-side with the longitudinal side wall of the respective first and second magnetic core pieces facing one another.

20. A method of manufacturing an electromagnetic component assembly comprising:

providing a first magnetic core piece having a top surface formed with a first inset depressed surface, a bottom surface opposing the top surface, and a longitudinal side wall interconnecting the top and bottom surfaces;

providing a second magnetic core piece having a top surface formed with a second inset depressed surface, a bottom surface opposing the top surface, and a longitudinal side wall interconnecting the top and bottom surfaces;

wherein each of the first and second core pieces includes a first vertical slot formed in the longitudinal side wall;

providing a preformed coil winding separately provided from each of the first and second magnetic core pieces, the preformed coil winding defining less than one complete turn and including a first horizontally extending surface mount terminal tab, a first vertical leg, and a main winding section; and receiving the first vertical leg partly in the first vertical slot of each magnetic core piece, recieving the main winding section on part of each of the first and second inset depressed surfaces and extending the first surface mount terminal tab partly on the bottom surfaces of the first and second magnetic core pieces.

21. The method of claim 20, further comprising arranging the first and second core magnetic pieces side-by-side with the longitudinal side wall of the respective first and second core pieces facing one another.

22. The method of claim 20, further comprising exposing the main winding section on the top surface of the first magnetic core piece and on the top surface of the second magnetic core piece.

23. The method of claim 20, wherein the preformed coil winding further includes a second vertical leg and a second surface mount terminal tab, wherein the second surface mount terminal tab extends in an opposite direction to the first surface mount terminal tab, wherein the each of the first and second core pieces includes a second vertical slot formed in the longitudinal side wall, the first and second vertical slots being spaced from one another, and the method comprising:

receiving the second vertical leg of the coil winding partly in the second vertical slot of each of the first and second magnetic core pieces.

24. The method of claim 21, wherein at least one of the first and second core pieces includes an inset surface formed in the longitudinal side wall, the method comprising defining a physical gap with the inset surface when the first and second magnetic core pieces are arranged side-by-side with the longitudinal side wall of the respective first and second magnetic core pieces facing one another.

25. The method of claim 21, wherein each of the first and second magnetic core pieces further includes a lateral side wall extending perpendicular to the longitudinal side wall, the lateral side walls of the first and second magnetic core pieces defining an overall length dimension of the component in combination, the method comprising extending the first terminal tab entirely across the length dimension of the component.

26. An electromagnetic component assembly comprising:

a first magnetic core piece having a top surface formed with a first inset depressed surface, a bottom surface opposing the top surface, and a longitudinal side wall interconnecting the top and bottom surfaces;

a second magnetic core piece having a top surface formed with a second inset depressed surface, a bottom surface opposing the top surface, and a longitudinal side wall interconnecting the top and bottom surfaces; and a preformed coil winding formed separately from each of the first and second magnetic core pieces, the preformed coil winding completing less than one turn and including a pair of horizontally extending surface mount terminal tabs and, a pair of vertical legs extending upwardly from the pair of surface mount terminal tabs, and a main winding section extending between the pair of vertical legs;

wherein each of the first and second magnetic core pieces includes a first vertical slot and a second vertical slot formed in the longitudinal side wall thereof, the respective first and second vertical slots in each of the first and second magnetic core pieces defining ends of the first inset depressed surface and the second inset depressed surface; and wherein the pair of vertical legs are received partly in the first vertical slot and the second vertical slot of each of the first and second magnetic core pieces;

wherein the main winding section extends partly on the first and second inset depressed surfaces of the first and second magnetic core pieces and wherein the main winding section is exposed on the top surface.

27. The electromagnetic component assembly of claim 26, wherein at least one of the longitudinal side walls of the first and second magnetic core pieces includes an inset surface forming a physical gap when the longitudinal side walls of the first and second magnetic core pieces are drawn together.

28. The electromagnetic component assembly of claim 26, wherein the component is a power inductor.

29. A component formed by the method of claim 21.

30. The component of claim 29, wherein the component is a power inductor.

* * * * *